US007401422B1

(12) United States Patent
Scholz et al.

(10) Patent No.: US 7,401,422 B1
(45) Date of Patent: Jul. 22, 2008

(54) PLATE FOR RUNNING SHOE

(75) Inventors: Wolfgang Scholz, Lonnerstadt (DE); Daniel Eugene Norton, Narberth, PA (US); Patrizio Carlucci, Rome (IT); Berthold Krabbe, Scheinfeld (DE); Christoph Berger, Egloffstein (DE)

(73) Assignee: adidas International Marketing B.V., Amsterdam (NL)

( * ) Notice: Subject to any disclaimer, the term of this patent is extended or adjusted under 35 U.S.C. 154(b) by 754 days.

(21) Appl. No.: 09/561,584

(22) Filed: Apr. 28, 2000

(30) Foreign Application Priority Data

Apr. 28, 1999 (DE) ..... 199 19 409
Feb. 24, 2000 (EP) ..... 00103409

(51) Int. Cl.

| | |
|---|---|
| ***A43B 7/14*** | (2006.01) |
| ***A43B 1/10*** | (2006.01) |
| ***A43B 13/02*** | (2006.01) |
| ***A43B 13/04*** | (2006.01) |
| ***A43B 13/24*** | (2006.01) |
| ***A43B 13/38*** | (2006.01) |
| ***A43B 23/00*** | (2006.01) |

(52) U.S. Cl. ..... 36/44; 36/88; 36/102; 36/107; 36/75 R; 36/166

(58) Field of Classification Search ..... 36/129, 36/87, 88, 91, 92, 93, 102, 103, 107, 108, 36/27, 30 R, 31, 43, 44, 76 C, 82, 72 R, 72 A, 36/73, 75 R, 148, 149, 151, 152, 166, 167, 36/168, 169, 171, 172, 173, 175, 176, 177, 36/178, 179, 182, 154

See application file for complete search history.

(56) References Cited

U.S. PATENT DOCUMENTS

| | | | | |
|---|---|---|---|---|
| 3,394,473 | A * | 7/1968 | Romen | 36/44 |
| 4,231,169 | A * | 11/1980 | Toyama et al. | 36/44 |
| 4,435,910 | A * | 3/1984 | Marc | 36/44 |
| 4,510,700 | A * | 4/1985 | Brown | 36/44 |

(Continued)

FOREIGN PATENT DOCUMENTS

| | | |
|---|---|---|
| DE | 1885452 | 1/1964 |

(Continued)

OTHER PUBLICATIONS

English language translation of Brief in Support of Opposition to German Patent No. 199 19 409.2 "Sports Shoe" owned by adidas International Marketing B.V., Amsterdam, NL, dated Feb. 24, 2003.

(Continued)

*Primary Examiner*—Anthony D Stashick
(74) *Attorney, Agent, or Firm*—Goodwin Procter LLP

(57) ABSTRACT

The invention relates to a shoe, in particular a sprint shoe, including a plate arranged in a sole area of the shoe. The plate extends essentially over the complete length of the sole area and is substantially planar in a forefoot part and is constructed of a material and configured to allow for elastic bending of the plate in the longitudinal direction, and is configured to three-dimensionally encompasses a rearfoot part of the foot. Optionally, the plate includes a heel cup in the rearfoot part to cradle the foot. Further, a wedge- or rib-like raised part may be arranged below the heel cup.

20 Claims, 5 Drawing Sheets

U.S. PATENT DOCUMENTS

| | | | | | |
|---|---|---|---|---|---|
| 4,546,559 | A | * | 10/1985 | Dassler | 36/31 |
| 4,718,179 | A | * | 1/1988 | Brown | 36/44 |
| 4,766,679 | A | | 8/1988 | Bender | |
| 4,821,430 | A | | 4/1989 | Flemming et al. | |
| 5,052,130 | A | | 10/1991 | Barry et al. | |
| 5,184,409 | A | * | 2/1993 | Brown | 36/44 |
| 5,394,626 | A | * | 3/1995 | Brown | 36/44 |
| 5,619,809 | A | * | 4/1997 | Sessa | 36/28 |
| 6,119,370 | A | * | 9/2000 | Baron | 36/44 |

FOREIGN PATENT DOCUMENTS

| | | | |
|---|---|---|---|
| DE | 2732463 | | 2/1979 |
| DE | 39 24 360 | A1 | 1/1991 |
| DE | 3924360 | A1 | 1/1991 |
| DE | 9013560.1 | | 1/1991 |
| DE | 4101236 | A1 | 7/1992 |
| EP | 0 272 028 | A2 | 6/1988 |

OTHER PUBLICATIONS

English translation of Opposition to: German Patent No. 199 19 409 "*Sports Shoe*" owned by adidas international B.V. Amsterdam, NL.
English translation of Supplemental Opposition to: German Patent No. 199 19 409 "Sports Shoe " owned by adidas international B.V. Amsterdam, NL.
"*Mizuno Technology: The Competitive Edge*" Sportshop Aug. 1992 Edition, p. 157 and Feb. 1993 Edition, p. 13.
"*Warmups*" Runners World, Jan. 1992 Edition, p. 10.
Noel France, S.A. Line 7 Catalog, Jan. 1992, p. 10.

* cited by examiner

PLATE FOR RUNNING SHOE

CROSS-REFERENCE TO RELATED APPLICATIONS

This application incorporates by reference, and claims priority to and the benefit of, German patent application serial number 19919409.2, which was filed on Apr. 28, 1999, and European patent application no. 00103409.9, which was filed on Feb. 24, 2000.

TECHNICAL FIELD

The invention relates to articles of footwear such as sports shoes, in general, and in particular to a sprint shoe with a plate arranged in the sole area.

BACKGROUND INFORMATION

Sport shoes for track and field competitions, in particular for sprinting over short distances, have conflicting requirements. For example, the shoes should be as lightweight as possible, because the weight of the shoes can obstruct fast movements of an athlete during the sprint. The importance of lightweight construction follows from the fact that a reduction of the weight of the shoe by 30 g leads to a reduction of energy consumption during running of 0.3%; however, the shoes must have sufficient stability against deformation so that the foot is sufficiently supported and guided during running.

Another consideration in the construction of sprint shoes is the elastic storing of energy by the shoe during the course of movement. During each landing phase, the shoe is deformed in the forefoot part by the rolling-off with the ball of the foot and the toes. During the subsequent push-off with the toes, the foot is straightened and the shoe returns to its original shape. These movements are repeated with each step during running.

In contrast to the commonly used layer ensemble of foamed materials for the forefoot part of a normal sports shoe, it may be possible to provide for an elastic storing of energy needed for the deformation of the shoe by a flat bending elastic plate in the forefoot part of sprint shoes, which extends into the mid and rearfoot part. In a step cycle, this plate is bent in its longitudinal direction during the rolling-off phase and elastically springs back during the subsequent push-off to its original shape and thereby supports the course of movements of the sprinter.

One example of such a bending elastic plate is disclosed in U.S. Pat. No. 5,052,130. The essentially flat plate of carbon fibers disclosed therein has a great bending stiffness in a longitudinal direction. It occupies the complete width of the sole in the forefoot part, but is considerably narrower in the rearfoot part, purportedly to allow, apart from storing energy, good damping of the shoe by viscous materials during first ground contact.

Another example of a bending elastic plate is disclosed in European Patent No. 0 272 082. Here, the flat plate also extends essentially over the complete length of the shoe. An additional damping material may be provided in the rearfoot part, purportedly to reduce the stress on the foot during the ground contact of the heel.

Sprint shoes according to the above discussed prior art however, have the disadvantage that the spring force of the elastic plate is not sufficiently transmitted during push-off to the complete foot. In particular, the heel part is not sufficiently included in the overall procedure due to the softer materials provided in the heel part. Although the plate itself stores energy elastically, with minimal losses, the return of invested energy, the intended effect, is only partially achieved.

SUMMARY OF THE INVENTION

It is therefore one object of the present invention to provide a shoe, in particular a sprint shoe, with a bending elastic plate, where the plate effectively catapults the complete foot in a forward direction when it springs back, and supports the complete foot during the course of movements of the athlete.

In one aspect, the invention relates to an article of footwear, such as a shoe, including a sole and a plate. The plate includes a forefoot part and a rearfoot part and extends over substantially the entire sole. The forefoot part is substantially planar and constructed of a material and configured to allow for an elastic bending of the plate. The rearfoot part is configured to three-dimensionally encompass a heel of a foot.

Because the plate covers substantially the complete length of the shoe, its stiffness determines the elastic properties of the shoe. The planar shape in the forefoot part acts like a "leaf spring," which is deflected during each step in the rolling-off phase and which elastically springs back during pushing off into its original planar shape. The elasticity of the forefoot part of the plate assures that the energy invested for the deflection of the "leaf spring" is essentially regained without any loss.

The rearfoot part of a plate in accordance with the invention has a different primary objective. Since the foot of a sprinter is encompassed three-dimensionally, the rearfoot part of the plate is comparatively rigid and therefore transmits, with minimal loss, the springing back of the plate to the complete foot including the heel. The damping of the rearfoot part stressed in the prior art is not necessary in sprint shoes, because during the sprint, the athlete runs exclusively on the forefoot part without contacting the ground with the heel.

In various embodiments, the forefoot part has a stiffness of between about 40 N/mm and about 120 N/mm, and preferably between about 60 N/mm and about 100 N/mm, measured according to ASTM 790. The plate has an associated energy loss as a result of bending the forefoot part of the plate of less than about 5%. The rearfoot part can include a heel cup that cradles the foot, a wedge- or rib-like raised portion disposed beneath the rearfoot part, specifically located beneath the heel cup if the plate is so equipped, and at least one damping element disposed beneath the rearfoot part. The heel cup effectively supports the foot against turning to the medial or lateral side and reduces the danger of injuries of the foot, ankle, and knee joints. In one embodiment, the damping element can extend around the rib-like raised portion and/or is horseshoe shaped. In situations where the rearfoot part contacts the ground, for example during normal walking, an additional damping element can be arranged below the heel cup. The additional damping element is effective during slightly sideways ground contact of the heel. When the rib-like raised portion is arranged below the heel cup, it brings the foot into a forward position during running, which facilitates running on the forefoot part without ground contact of the heel. In another embodiment, the stiffness of the forefoot part is greater than the stiffness of the rearfoot part. This would result in, for example, a "leaf spring" action of the forefoot part, and at the same time a softer and therefore more comfortable rearfoot part.

In further embodiments, the plate can form the outsole, insole, or midsole of a shoe. The plate can be also be arranged within a corresponding recess of an outsole, where the outsole material is typically softer than the plate material. In addition, the plate can include a carrier located beneath the forefoot part, the carrier configured for mounting at least one profile element. In other embodiments, the forefoot part and rearfoot part of the plate are separate parts coupled together, typically rigidly coupled. The separate parts can be coupled together by a plurality of corresponding protrusions and recesses, or holes. The separate parts can be made of materials of differing properties, for example, the forefoot part can be made of a carbon fiber composite and the rearfoot part of a combination of materials.

In yet additional embodiments, the forefoot part can include a plurality of individual extensions configured for the selective and flexible support of the toes of a foot. The individual extensions allow independent movement of the toes, without losing the beneficial elastic bending characteristics of the plate. Also, the plate can include openings for ventilation of the interior of the shoe. The openings, or holes, can be located on the forefoot part, rearfoot part, or the outsole.

These and other objects, along with advantages and features of the present invention herein disclosed will become apparent through reference to the following description of embodiments of the invention, the accompanying drawings, and the claims.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention. In the following description, various embodiments of the present invention are described with reference to the following drawings.

DETAILED DESCRIPTION

Figure 1:
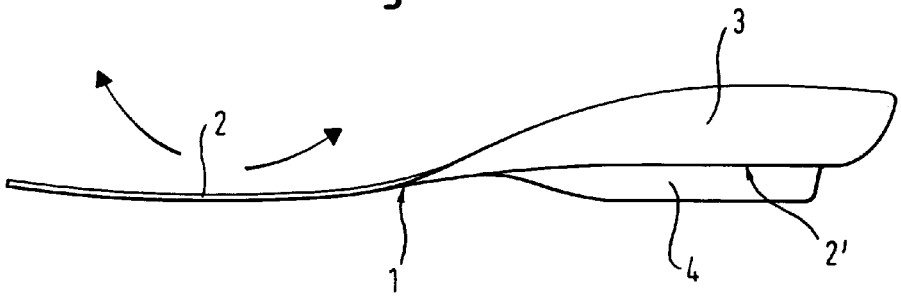
FIG. 1 is a schematic side view of one embodiment of a plate according to the invention.

With reference to FIG. 1, a sports shoe according to the invention includes a plate 1 arranged in the sole area of a foot. For simplicity, only the plate 1, together with an optional damping element 10, is shown in FIGS. 1 through 4. The exact arrangement within the sole area of the shoe is discussed further below, with reference to FIGS. 5 through 7.

As depicted in FIG. 1, the plate 1 includes a generally planar forefoot part 2. The forefoot part 2 may have a thickness of about 1 mm. The thickness of the forefoot part 2 may vary depending on the material used. The material for the spring plate is typically a composite material. Composite materials may include: graphite, fiberglass, carbon fibers embedded in a matrix of resin, or para-aramid fibers, such as the Kevlar® brand sold by DuPont. These materials combine high stiffness and low energy loss with low weight. Alternatively, the use of spring steel or other elastic metal alloys is possible. Further, suitable plastic materials include thermoplastic polyether block amides, such as the Pebax® brand sold by ElfAtochem, and thermoplastic polyester elastomers, such as the Hytrel® brand sold by DuPont. Plastic materials have advantages with respect to production by injection molding; however, the most desirable elastic properties might only be obtained by additional reinforcement with fibers. Other suitable materials and combination of materials will be apparent to those of skill in the art.

In its original shape, the forefoot part 2 is substantially planar and only slightly curved. During the rolling-off phase of a step, the forefoot part 2 is deformed as indicated by the two arrows in FIG. 1. This deflection causes tension outside the forefoot part 2 of the spring plate 1 and compression inside the forefoot part 2 of the spring plate 1, storing the energy necessary for the deflection. If the foot (not shown) is stretched, the forefoot part 2 releases the stored energy by elastically springing back to its original shape, thereby supporting the pushing-off of the toes from the ground.

In the embodiments shown in FIGS. 1 through 7, the plate 1 not only extends over the complete length of the shoe, but also over the complete width of the forefoot part 2 and the rearfoot part 2'. Narrower or perforated embodiments are also possible, as long as the bending characteristics of the shoe over its complete length are essentially defined by the stiffness of the plate.

To provide noticeable support for the movements of the athlete by the storing and releasing of energy, the stiffness of the plate 1 in the forefoot part 2 should be sufficient so that the deformations of the remaining parts of the shoes are not significant; however, the forefoot part 2 should not be too stiff. If the stiffness is too great, the movements of the athlete during running are obstructed. Studies have shown that preferred stiffnesses between about 40 N/mm to about 120 N/mm yield the desirable results.

Figure 8:
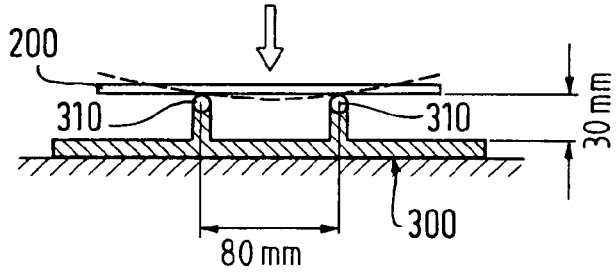
FIG. 8 is a schematic representation of a test set-up, according to ASTM 790, for determining the stiffness of sample plates for the forefoot part of a plate.

The above mentioned values were determined by the test set-up 300 shown in FIG. 8 to measure the stiffness according to ASTM 790. To this end, a 250 mm long and 50 mm wide sample plate 200 is symmetrically positioned on two supporting points 310 spaced 80 mm apart. Subsequently, the sample plate is deflected with a vertical force acting on the center of the plate (vertical arrow in FIG. 8). The desired minimal deflection of the sample plate is 12 mm to assure sufficient stability for use in a shoe. A dynamometer can be used to determine the deflection of the sample plate independent of the applied force. The stiffness is the gradient of the curve measured in this way in the linear range, i.e., the range of small deflections.

Figure 9:
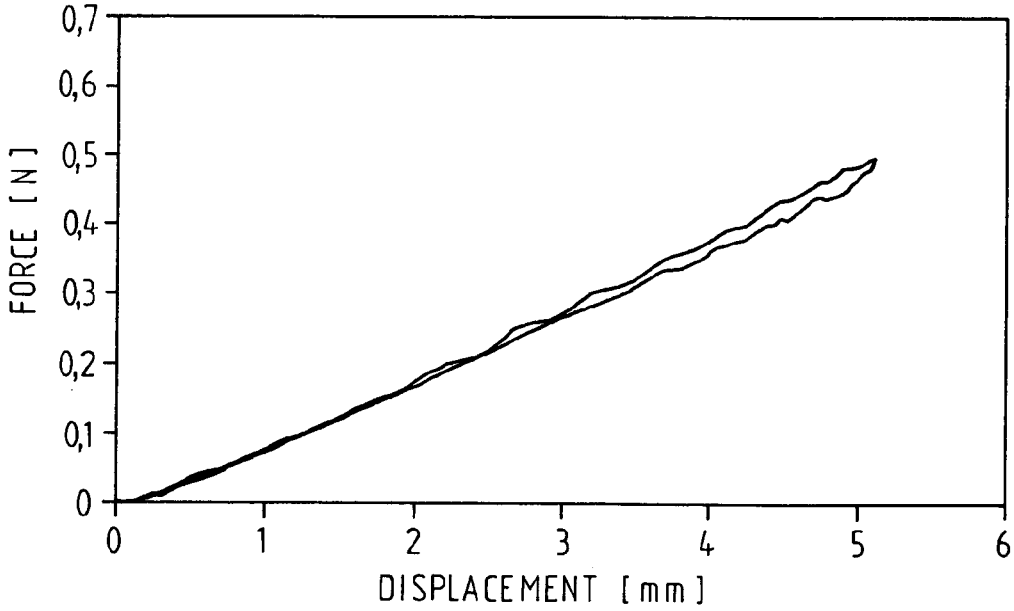
FIG. 9 is an exemplary hysteresis curve of a sample plate for determining the energy loss during deflection.

An additional desirable characteristic for a sample material for a plate according to the invention is its elasticity, that is, how much of the energy necessary for the deflection of the sample plate is regained when the plate springs back into its original shape. FIG. 9 shows an exemplary hysteresis curve for a sample plate with a stiffness of 100 N/mm. The above described set-up 300 was used to measure the force when the plate was periodically deflected and released, where a measuring cycle had a period of 200 msec. Whereas the total area below a curve corresponds to the total stored energy, the difference between the upper and the lower curve, i.e., the area enclosed by the two lines, represents the loss of energy when the sample plate is deflected. In the example shown, the energy loss amounts to about only 4.6% of the stored energy. For the use in the forefoot part of a plate in accordance with the invention, the energy loss of the plate should be less than about 10% and is preferably less than about 5%.

As shown in FIGS. 1 through 4, the rearfoot part 2' of the plate 1 is not planar but has a three-dimensional shape to encompass the foot of the athlete. In one embodiment, a heel cup 3 is provided in the upper part of the rearfoot part 2', which encompasses the heel of the athlete on three sides in a cradling manner. Thereby, reliable support not only of the heel, but also of the arch of the foot, is achieved.

Apart from the shown embodiment where the foot is completely encompassed by the heel cup 3, it is also possible to provide the three-dimensional shape only in parts of the rearfoot part 2' in order to further reduce the overall weight of the shoe. It is, however, desired that the rearfoot part 2' of the plate 1 does not allow substantial deformation of the shoe in this part, but transmits, with minimal loss, the springing action of the elastic deflection of the forefoot part to the heel of the athlete.

According to a further embodiment, a generally centrally disposed wedge- or rib-like raised portion 4 is provided below the heel cup and optionally is integrally formed together with the plate 1 and may consist of the same material. Thus, two objectives are achieved. First, the athlete is automatically brought into the desired, forwardly directed position, which is important for fast running on the forefoot part 2. Second, the wedge-like raised portion 4 compensates, at least partly, for the upwardly directed curvature of the forefoot part 2 as is typically caused by the last during the manufacture of the shoe. The forefoot part 2 is therefore in its original substantially planar shape, so that a larger deflection range is available for elastic deformation than otherwise.

Figure 2:
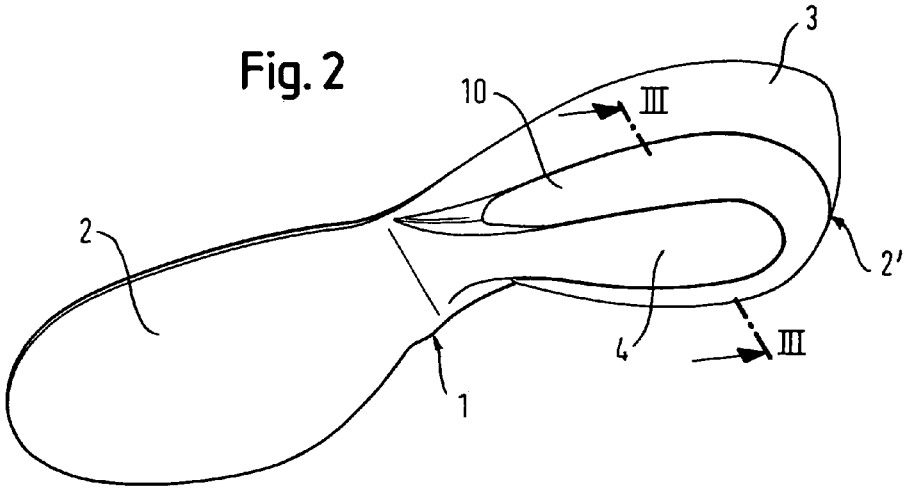
FIG. 2 is a schematic perspective view of the embodiment of FIG. 1 as shown from below, including a damping element.
Figure 3:
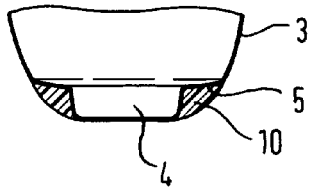
FIG. 3 is a schematic partial cross-sectional view taken along line III-III in FIG. 2.
Figure 4:
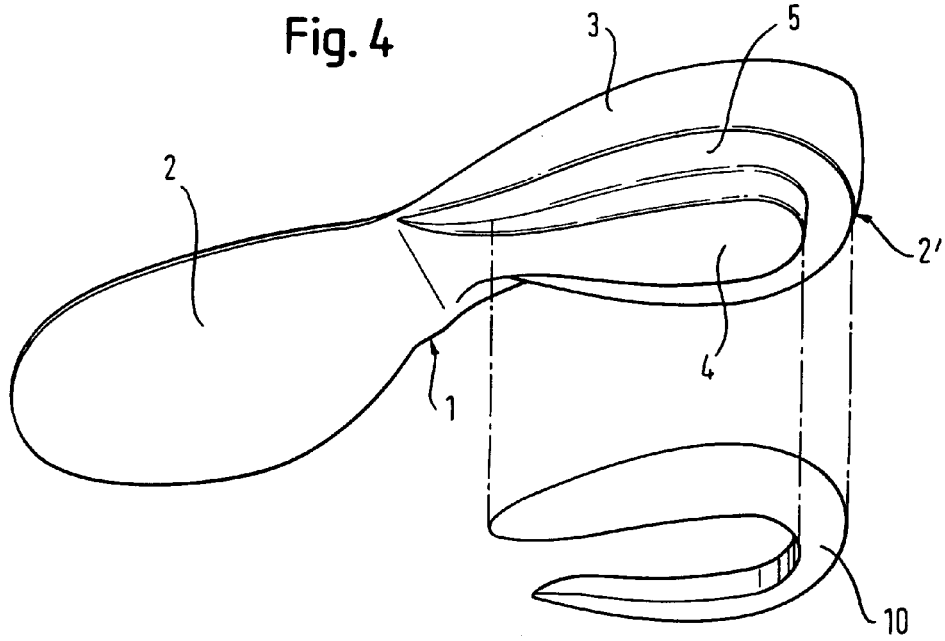
FIG. 4 is a schematic view of the plate of FIG. 2 with the damping element displaced therefrom.

Optionally, a damping element 10 may be provided below the heel cup 3 and disposed about a periphery of the wedge-like raised portion 4, as shown in FIG. 2. The damping element 10 dampens the contact between the heel and the ground in the event the athlete is not only running on the forefoot part 2, but changes over to running on the heel. At the same time, the plate 1 is protected against damage. The damping element 10 can be combined with the wedge-like raised portion 4 in a number of different configurations. Further, it is also possible to completely replace the wedge-like raised portion 4 with a damping element. In the embodiments shown in FIGS. 1 through 4, the wedge-like raised portion 4 is set back with respect to the periphery of the plate 1 in the rearfoot part 2' on all three exterior sides so that a recess or step 5 of about 1 cm is formed within which a horse shoe shaped damping element 10 is disposed. By this shape, the ground contact of the heel is also dampened if the foot is in a slightly inclined position. The damping element 10 may be made out of a typical rubber-like damping material, such as EVA (ethylene-vinyl-acetate) or a butyl-polymer. Suitable damping materials will be known to one of ordinary skill in the art. In addition, the damping element 10 can be used to influence the exterior design of the shoe, for example with respect to its shape and/or color.

Figure 5:
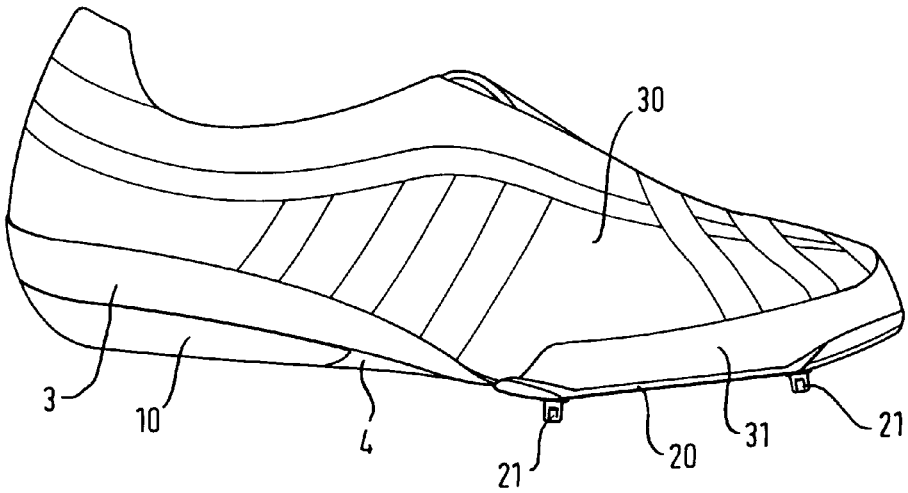
FIG. 5 is a schematic side view of a sports shoe incorporating the plate shown in FIGS. 1 through 4.
Figure 7:
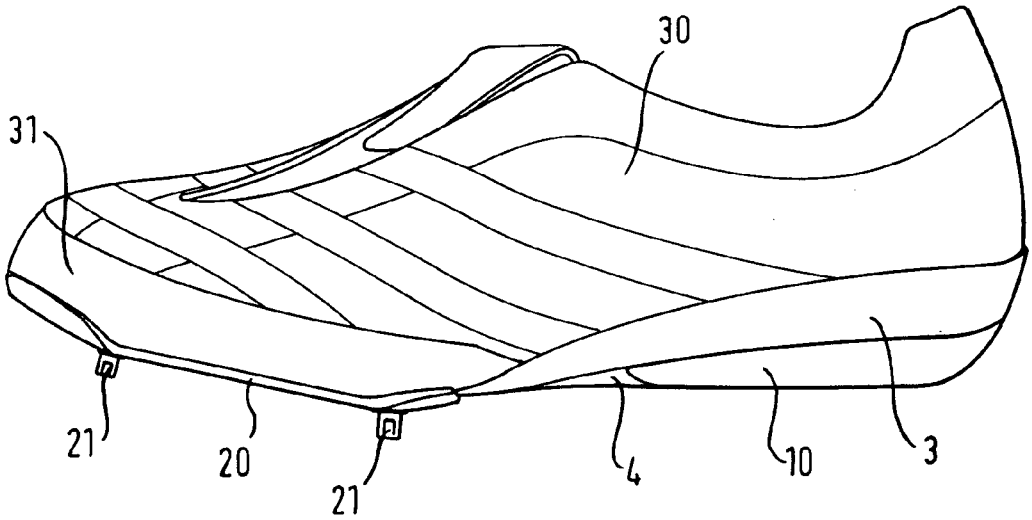
FIG. 7 is a schematic side view of the sport shoe shown in FIG. 5 taken from the opposite side.

FIG. 5 shows another embodiment of a shoe in accordance with the invention. A sole is disposed below the upper 30. A plate 1 in accordance with the invention is integrated into the sole. In FIGS. 5 and 7, only the heel cup 3 and the damping element 10 can be seen. In a further embodiment, the upper 30 in the rear part of the shoe is fixed to the inner side of the heel cup 3, for example by gluing, and protects the foot from direct contact with the comparatively hard plate 1 to provide greater comfort. In the front part of a shoe according to one embodiment, a reinforcement 31 of the upper material of the shoe is provided which extends peripherally around the plate 1 and is fixed to its lower side.

Figure 6:
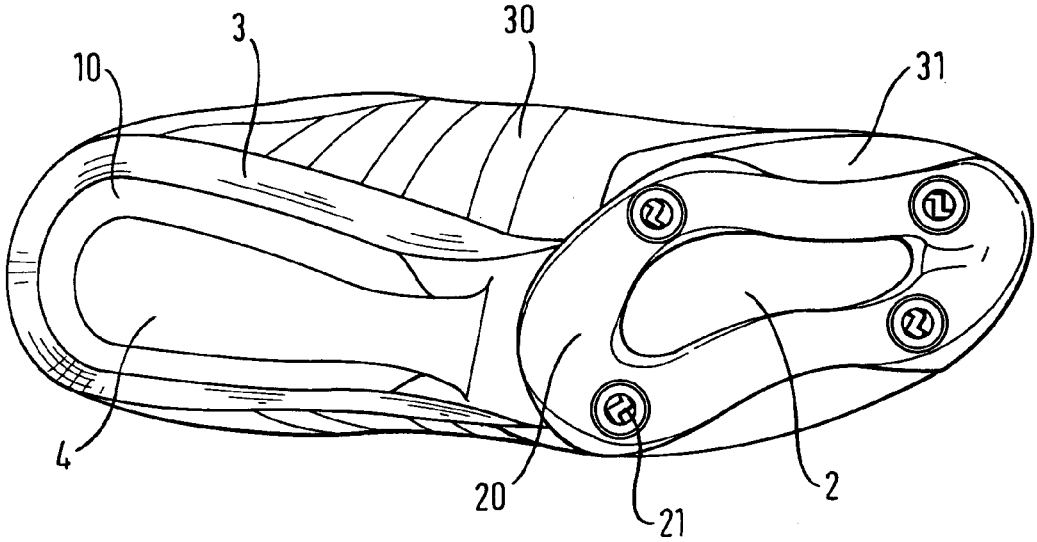
FIG. 6 is a schematic bottom view of the sport shoe shown in FIG. 5.

As can be seen from FIG. 6, an additional carrier or frame 20 is provided below the forefoot part 2 of the plate 1. This carrier serves to receive spikes or profile elements 21, for example the screwed studs shown. Depending on the material which is used for the plate 1, the profile element 21 may also be directly integrated into the forefoot part 2 of the plate 1. The carrier 20 is typically made out of a comparatively soft and lightweight plastic material to avoid influencing the stiffness of the shoe. If profile elements 21 are also to be arranged in the rearfoot part 2', a corresponding carrier (not shown) may be arranged there, or the carrier 20 may be extended rearwardly to the desired position and provided with a suitably flexible region between the forefoot part 2 and the rearfoot part 2' to avoid influencing the stiffness of the shoe.

In another embodiment, the plate 1, apart from the carrier 20, forms the outer running sole, or outsole, of the shoe. This is, however, only one possibility. The plate 1 may also be arranged above the outsole. Alternatively, to reduce weight, no continuous sole is provided, and the plate 1 may be arranged above several separate sole elements or carriers 20. The plate 1 may be preferably arranged as close as possible to the foot of a runner. If a sole or a sole ensemble of several layers is used, it is possible to provide the plate 1 as a mid- or insole. The other layers, however, should not overly influence the elasticity or stiffness in the forefoot part 2. Alternatively, the described properties may be achieved by the combination of several layers as opposed to a single sole layer.

Figure 10:
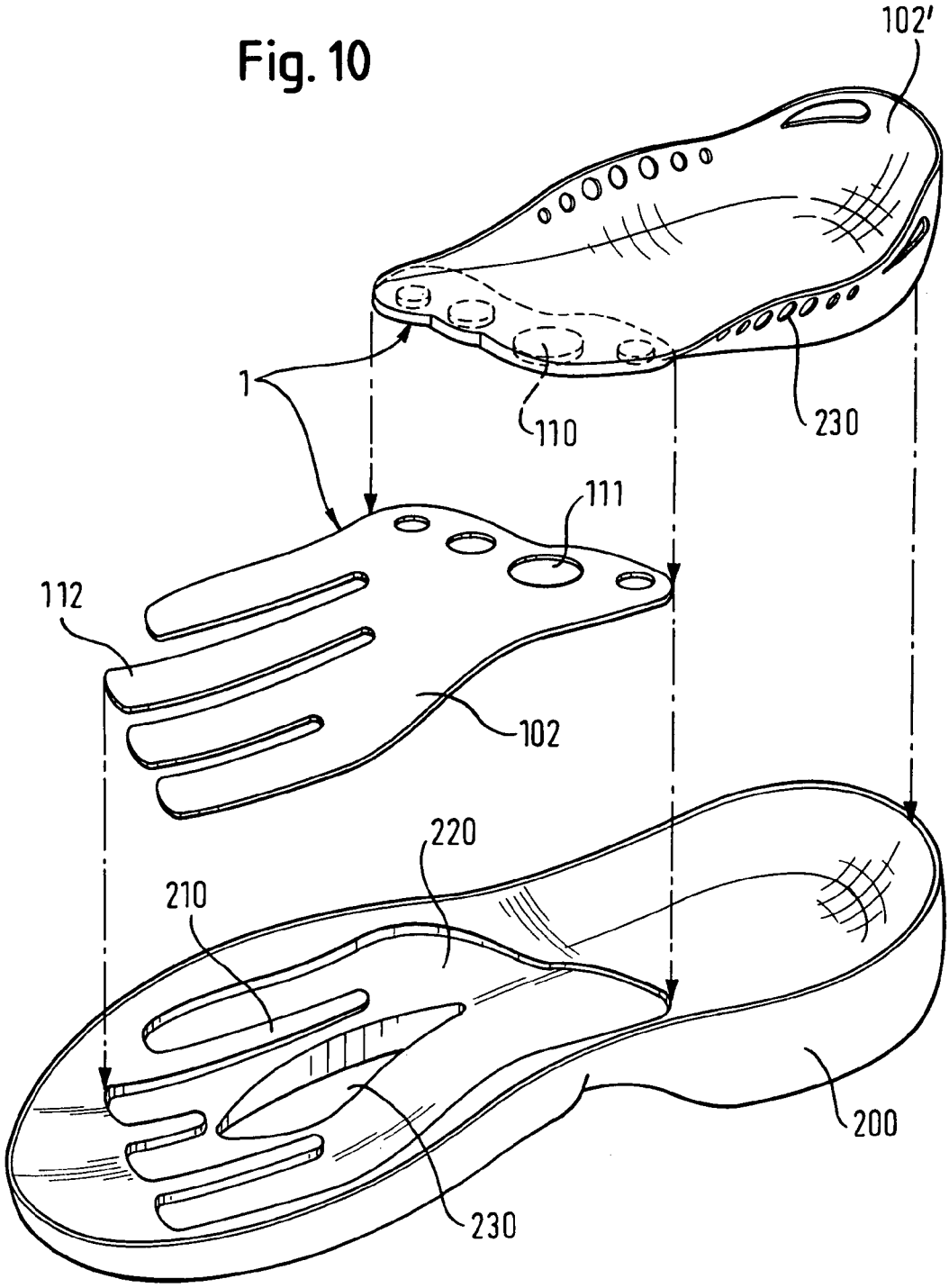
FIG. 10 is a schematic perspective view of an embodiment of another plate showing a two-part plate and an outsole arranged below the plate.

A further embodiment of a plate 1 in accordance with the invention is shown in FIG. 10. In this embodiment, the plate 1 consists of two parts 102 and 102', which are rigidly interconnected by a plurality of mating protrusions 110 and recesses or holes 111 in the forefoot part 102 and the rearfoot part 102', or vice versa. The two parts 102, 102' may alternatively or additionally be glued together or otherwise attached to achieve a mechanically stable plate 1 that will elastically resist the arising mechanical stress during elastic bending.

The separation into a forefoot part 102 and a rearfoot part 102' allows tailoring of each part for its desired function during an athlete's gait cycle, without significantly increasing production costs. Whereas the substantially planar forefoot part 102 is designed to store elastic energy, the rearfoot part 102' itself is only slightly deflected and serves more for guiding and supporting the foot.

Accordingly, the forefoot part 102 may be comparatively stiff, as in the case of the embodiment described above; however, a slightly less stiff material may be used for the rearfoot part 102' of the plate. The rearfoot part 102' contacts the foot not only from below, but also from the side and from behind. Thus, a more comfortable guiding of the foot is achieved.

In order to selectively support the toes of the foot, two or more extensions 112 may be provided at the forefoot end of the plate 1, four extensions 112 being depicted here. The extensions 112 can be individually elastically deflected. Further, the slits formed between the extensions 112 may mate with ridges 210 of an outsole 200 having an optional recess 220 formed therein for receiving the plate 1. The recess 220 guarantees a direct mechanical interaction between the plate 1 and the outsole 200, substantially preventing slippage or relative movement therebetween, so that essentially no loss of the bending elasticity energy of the plate 1 is imparted to or dissipated in the outsole 200. To this end, the material of the outsole 200 is preferably softer than both the material of the forefoot part 102 and the rearfoot part 102' of the plate 1.

Typical materials for the outsole 200 are EVA foams, which combine good impact damping properties with light weight.

The outsole 200 provides damping, in a similar manner as the horseshoe-shaped damping element 10 of the first embodiment, when a shoe in accordance with the invention contacts the ground. The grip of the shoe may be improved by means of additional profile elements, such as those shown in FIGS. 5 and 7.

For improved ventilation, the outsole 200 as well as the forefoot part 102 and the rearfoot part 102' of the plate 1, may be provided with one or more apertures or holes 230 for air circulation into the interior of the shoe.

Having described certain embodiments of the invention, it will be apparent to those of ordinary skill in the art that other embodiments incorporating the concepts disclosed herein may be used without departing from the spirit and scope of the invention. The described embodiments are to be considered in all respects as only illustrative and not restrictive. Therefore, it is intended that the scope of the present invention be only limited by the following claims.

What is claimed is:

1. An article of footwear comprising:

a sole comprising a plate including a forefoot part and a rearfoot part, the plate extending over substantially the entire sole, and wherein the forefoot part has a substantially smooth planar surface and is constructed of a material and configured to allow for an elastic bending and spring back of the plate and the rearfoot part is configured to support a heel of a foot, wherein the plate effectively catapults the foot in a forward direction when the plate springs back, and wherein the plate forms an insole of the article of footwear.

2. An article of footwear comprising:

a sole comprising a plate including a forefoot part and a rearfoot part, the plate extending over substantially the entire sole, and wherein the forefoot part has a substantially smooth planar surface and is constructed of a material and configured to allow for an elastic bending and spring back of the plate and the rearfoot part is configured to support a heel of a foot, wherein the plate effectively catapults the foot in a forward direction when the plate springs back, and wherein the forefoot part and the rearfoot part are separate parts coupled together, each having different material properties.

3. An article of footwear according to claim 2, wherein the plate forms an outsole of the article of footwear.

4. An article of footwear according to claim 1 or 2, wherein a carrier is disposed under the forefoot part of the plate, the carrier configured for mounting at least one profile element.

5. An article of footwear according to claim 1 or 2 further comprising an upper attached to the sole.

6. An article of footwear according to claim 2, wherein the forefoot part and the rearfoot part are coupled together by a plurality of correspondingly engaging protrusions and recesses.

7. An article of footwear according to claim 1 or 2, wherein stiffness of the forefoot part is greater than stiffness of the rearfoot part.

8. An article of footwear according to claim 2, wherein the forefoot part comprises a plurality of individual extensions configured for selective and flexible support of toes of a foot.

9. An article of footwear according to claim 2, wherein the forefoot part comprises a carbon fiber composite material.

10. An article of footwear according to claim 2, wherein the plate is disposed as a midsole on top of an outsole.

11. An article of footwear according to claim 10, wherein the plate is arranged in a corresponding recess of the outsole.

12. An article of footwear according to claim 10, wherein outsole material is softer than plate material.

13. An article of footwear according to claim 12, wherein the plate forms at least one aperture therein for ventilation of an interior of the article of footwear.

14. An article of footwear according to claim 1 or 2, wherein the forefoot part comprises a stiffness between about 40 N/mm and about 120 N/mm.

15. An article of footwear according to claim 1 or 2, wherein the plate has an associated energy loss as a result of bending the plate, the loss being less than about 5%.

16. An article of footwear according to claim 1 or 2, wherein the rearfoot part of the plate comprises a heel cup, the heel cup cradling the foot.

17. An article of footwear according to claim 16, wherein a rib-like raised portion is disposed below the heel cup.

18. An article of footwear according to claim 17, wherein at least one damping element is disposed below the heel cup.

19. An article of footwear according to claim 18, wherein the at least one damping element extends around a periphery of the rib-like raised portion.

20. An article of footwear comprising:

a sole comprising a plate including a forefoot part and a rearfoot part, the plate extending over substantially the entire sole, and wherein the forefoot part has a substantially smooth planar surface and is constructed of a material and configured to allow for an elastic bending and spring back of the plate and the rearfoot part is configured to support a heel of a foot, wherein the plate effectively catapults the foot in a forward direction when the plate springs back, and wherein at least one damping element is disposed beneath the plate.

* * * * *